US005813391A

United States Patent [19]

Johnson

[11] Patent Number: 5,813,391

[45] Date of Patent: Sep. 29, 1998

[54] METHOD AND APPARATUS FOR PITCHING AND LOBBING BALLS

[76] Inventor: Albert Johnson, 3201 Sam Bass Rd., Round Rock, Tex. 78681

[21] Appl. No.: 390,063

[22] Filed: Feb. 17, 1995

[51] Int. Cl.[6] ..... A63B 65/12

[52] U.S. Cl. ..... 124/6; 124/81

[58] Field of Search ..... 124/1, 6, 78, 81

[56] References Cited

U.S. PATENT DOCUMENTS

| | | | |
|---|---|---|---|
| Re. 30,703 | 8/1981 | Paulson | 124/1 |
| 1,201,626 | 10/1916 | Reynolds | 124/6 |
| 1,316,397 | 9/1919 | Steinberger | 124/6 |
| 1,408,137 | 2/1922 | Parsons | 124/6 |
| 2,182,369 | 12/1939 | Barron | 124/81 |
| 2,254,496 | 9/1941 | Scally | 124/6 |
| 3,585,978 | 6/1971 | Hurliman | 124/6 |
| 3,613,655 | 10/1971 | Tobin et al. | 124/6 |
| 3,822,688 | 7/1974 | Mayne | 124/6 |
| 4,197,827 | 4/1980 | Smith | 124/78 |
| 4,323,047 | 4/1982 | McIntosh et al. | 124/1 |
| 4,423,717 | 1/1984 | Kahelin | 124/78 |
| 5,012,790 | 5/1991 | Bates | 124/81 |
| 5,413,085 | 5/1995 | Kraeft | 124/81 |

FOREIGN PATENT DOCUMENTS

| | | | |
|---|---|---|---|
| 87964 | 8/1896 | Germany | 124/6 |
| 437359 | 7/1934 | United Kingdom | 124/6 |
| 526908 | 9/1940 | United Kingdom | 124/6 |

*Primary Examiner*—John A. Ricci
*Attorney, Agent, or Firm*—Melvin A. Hunn; Felsman, Bradley, Gunter & Dillon, LLP

[57] ABSTRACT

The present invention is directed to a method and apparatus for throwing balls. In particular, it is useful for throwing baseballs and softballs, and for lobbing tennis balls. The apparatus includes a number of components which cooperate to discharge balls at a relatively high velocity. A rotor member is provided. It is coupled to a motor shaft of a motor, preferably an electrical motor. A stator member is provided having an inlet for receiving balls and an outlet for discharging balls. The stator member completely encloses the rotor member and motor shaft thus enclosing all moving parts. Preferably, the rotor member includes a mounting member which couples to the shaft of the motor and which is positioned substantially orthogonal to the shaft of the motor. Additionally, the rotor member includes first and second parallel rails which are coupled to the mounting member and spaced apart a preselected distance which is sufficient to accommodate the balls. Preferably, the stator member defines a generally disc-shaped cavity having a predefined circumference and a predefined width. Preferably, the first and second rails of the rotor are sufficiently long to extend across the predefined circumference of the disc-shaped cavity and are sufficiently wide to extend across the predefined width of the disc-shaped cavity. Preferably, the inlet of the stator member is located at a an axis of rotation of the rotor member, opposite from the mounting member so that balls may be deposited intermediate the first and second parallel rails. Preferably, the outlet is located on the stator member at a position which is substantially tangential to a circular path defined by the rotor member. An adjustable deflector member may be located at the outlet for modifying the trajectory of balls.

26 Claims, 13 Drawing Sheets

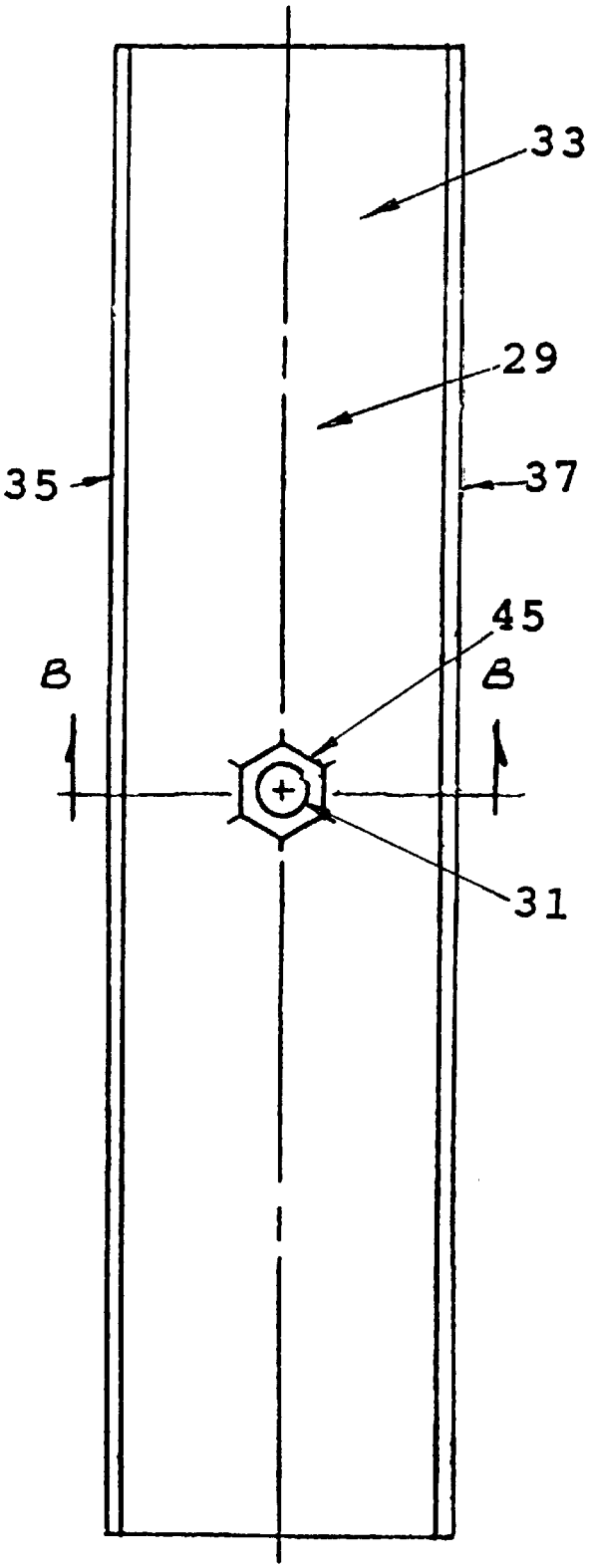
FIGURE 4
FIGURE 5
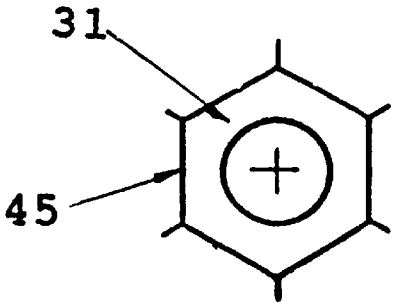

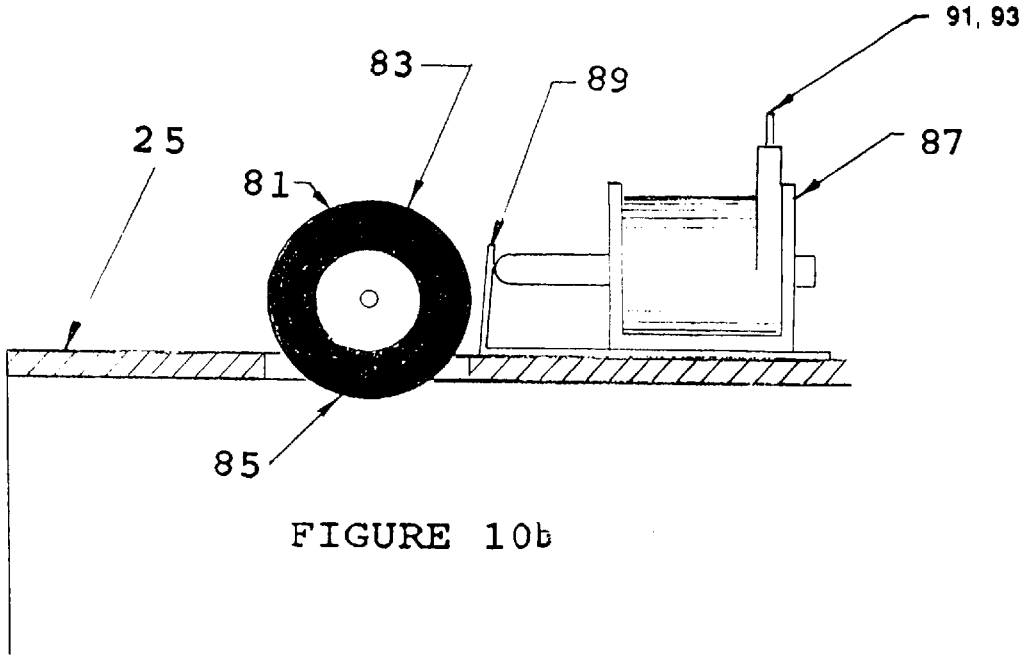
FIGURE 10b
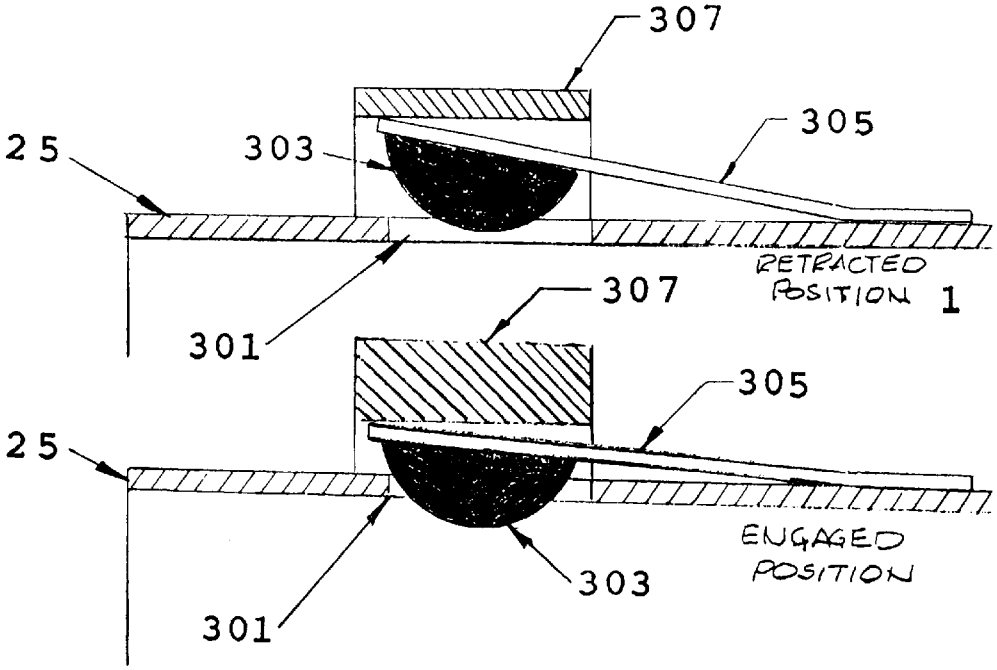
FIGURE 10c2

METHOD AND APPARATUS FOR PITCHING AND LOBBING BALLS

BACKGROUND OF THE INVENTION

1. Technical Field

The present invention relates in general to pitching and lobbing devices, which are suitable for pitching baseballs and softballs, and lobbing tennis balls.

2. Description of the Related Art

Prior art pitching and lobbing devices are not now widely used in the training of athletes due principally to the fact that such devices are prohibitively expensive. Typically, they comprise rather complicated machinery which ejects a ball through use of either centrifugal force or by gripping the balls with roller devices which serve to eject the ball.

Those devices described and claimed in U.S. Pat. Nos. 3,585,978 and 5,012,279 are good examples of devices which utilize centrifugal force to discharge a ball. These devices utilize a relatively complicated drive mechanism which transfers power from a prime mover to a throwing assembly. Additionally, both devices require some type of catch mechanism which holds the ball in place until it is ready for ejection. Both devices are relatively complicated devices with numerous exposed moving parts which present considerable safety risks.

The devices described and claimed in U.S. Pat. Nos. 4,197,827 and 4,423,717 are examples of the types of devices which utilize rotating wheels to eject the ball. These devices also require some means for gripping the ball for a predefined interval prior to ejection. In these types of devices, such gripping is typically accomplished with a rotating wheel or wheels. Additionally, numerous moving parts are exposed and these devices also present considerable safety concerns. Finally, these devices have numerous moving parts which present operating difficulties and potential malfunctions.

All of the prior art devices are so complicated that it is difficult to obtain low retail prices due to the cost of the parts, the cost of manufacturing, and considerable assembly requirements.

SUMMARY OF THE INVENTION

It is one objective of the present invention to provide a method and apparatus for throwing balls in which all moving parts are substantially enclosed in a manner which enhances safety.

It is another objective of the present invention to provide a method and apparatus for throwing balls which can attain extremely high throwing velocities; the apparatus of the present invention can attain velocities up to 100 miles per hour for baseballs, but can be adjusted to allow for a variety of pitching and lobbing speeds.

It is another objective of the present invention to provide an apparatus for throwing or lobbing balls which is of simple construction thus minimizing the number of moving parts, thereby facilitating manufacturing, assembly, and repair operations.

It is another objective of the present invention to provide a throwing apparatus which utilizes no mechanical mechanisms for retaining or positioning balls within a throwing armature, thus minimizing the probability of apparatus malfunction.

The foregoing objectives are achieved as is now described. The present invention is directed to a method and apparatus for throwing balls. In particular, it is useful for throwing baseballs and softballs, and for lobbing tennis balls. The apparatus includes a number of components which cooperate to discharge balls at a relatively high velocity. A rotor member is provided. It is coupled to a motor shaft of a motor, preferably an electrical motor. A stator member is provided having an inlet for receiving balls and an outlet for discharging balls. The stator member completely encloses the rotor member and motor shaft thus enclosing all moving parts. Preferably, the rotor member includes a mounting member which couples to the shaft of the motor and which is positioned substantially orthogonal to the shaft of the motor. Additionally, the rotor member includes first and second parallel rails which are coupled to the mounting member and spaced apart a preselected distance which is sufficient to accommodate the balls. Preferably, the stator member defines a generally disc-shaped cavity having a predefined circumference and a predefined width. Preferably, the first and second rails of the rotor are sufficiently long to extend across the predefined circumference of the disc-shaped cavity and are sufficiently wide to extend across the predefined width of the disc-shaped cavity. Preferably, the inlet of the stator member is located at an axis of rotation of the rotor member, opposite from the mounting member so that balls may be deposited intermediate the first and second parallel rails. Preferably, the outlet is located on the stator member at a position which is substantially tangential to a circular path defined by the rotor member. An adjustable deflector member may be located at the outlet for modifying the trajectory of balls. The throwing apparatus is operable in a plurality of modes of operation, including: (1) a ball reception mode of operation, wherein a ball is received at the inlet of the stator member, and urged by gravity away from a mid section of the rotor; (2) a ball acceleration mode of operation wherein the ball is accelerated by centrifugal force as the rotor member is rotated; and (3) a ball discharge mode of operation wherein the ball exists from the rotor from a particular one of the first and second ends and is routed by the stator member to exit from the outlet at a high velocity.

The above as well as additional objectives, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objectives and advantages thereof, will best be understood by reference to the following detailed description of an illustrative embodiment when read in conjunction with the accompanying drawings, wherein:

FIG. 4 is a plan view of the rotor member of the throwing apparatus of the present invention;

FIG. 5 is a detail view of a coupling between the rotor member and a motor shaft;

DETAILED DESCRIPTION OF PREFERRED EMBODIMENT

Figure 1:
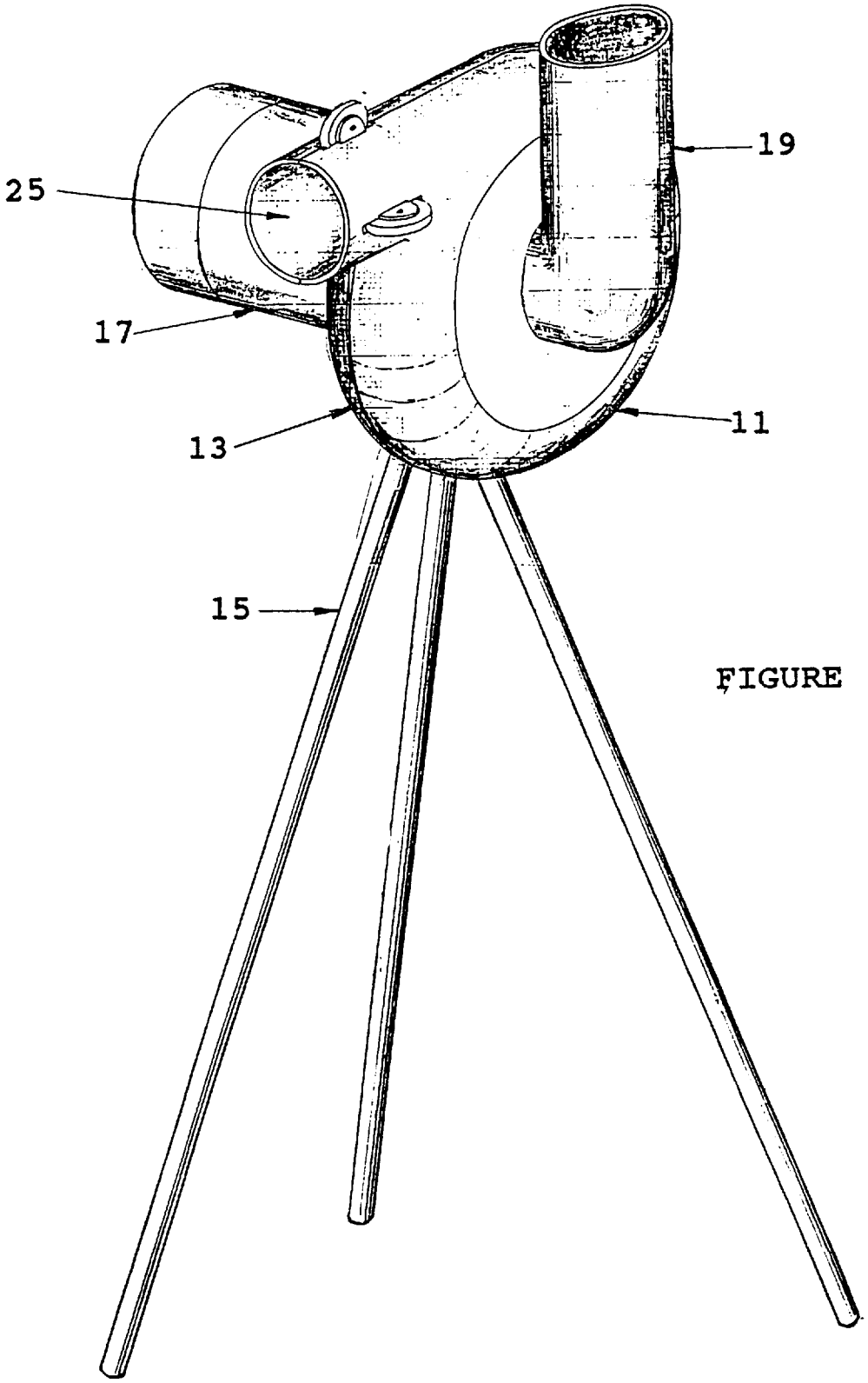
FIG. 1 is a perspective view of a throwing apparatus in accordance with the preferred embodiment of the present invention without a ball feed mechanism.

FIG. 1 is a perspective view of one embodiment of the throwing apparatus 11 of the present invention. As is shown, the apparatus includes a stator member 13 which is coupled to a base 15 which is utilized to support stator member 13 in a selected position above a field or playing surface. In FIG. 1, base 15 is depicted as three-legged device; however, in other embodiments, stator member 13 can be secured above a field or playing surface by a single pole which is secured in the field or playing surface. Also, as is shown in FIG. 1, throwing apparatus 11 includes motor 17 which is utilized to energize throwing apparatus 11. Preferably, motor 17 is an electrical motor which is powered by an extension cord which receives electrical energy from a conventional outlet; however, in alternative embodiments, motor 17 can comprise a gas-powered motor to allow use of throwing apparatus 11 in locations which do not have access to conventional electrical energy. Also, as is shown in FIG. 1, throwing apparatus 11 includes a ball feed member 19 which is utilized to hold several balls 21, such as baseballs, softballs or tennis balls. In the view of FIG. 1, ball feed member 19 is shown attached to stator member 13. In operation, ball feed member 19 couples to ball inlet 23 of stator member 13 (which is not depicted in this view). A rotor disposed within stator member 13 serves to accelerate the balls, one at a time, and eject them from ball outlet 25 of stator member 13. As is shown, ball outlet 25 is disposed generally tangentially to stator member 13.

Figure 2:
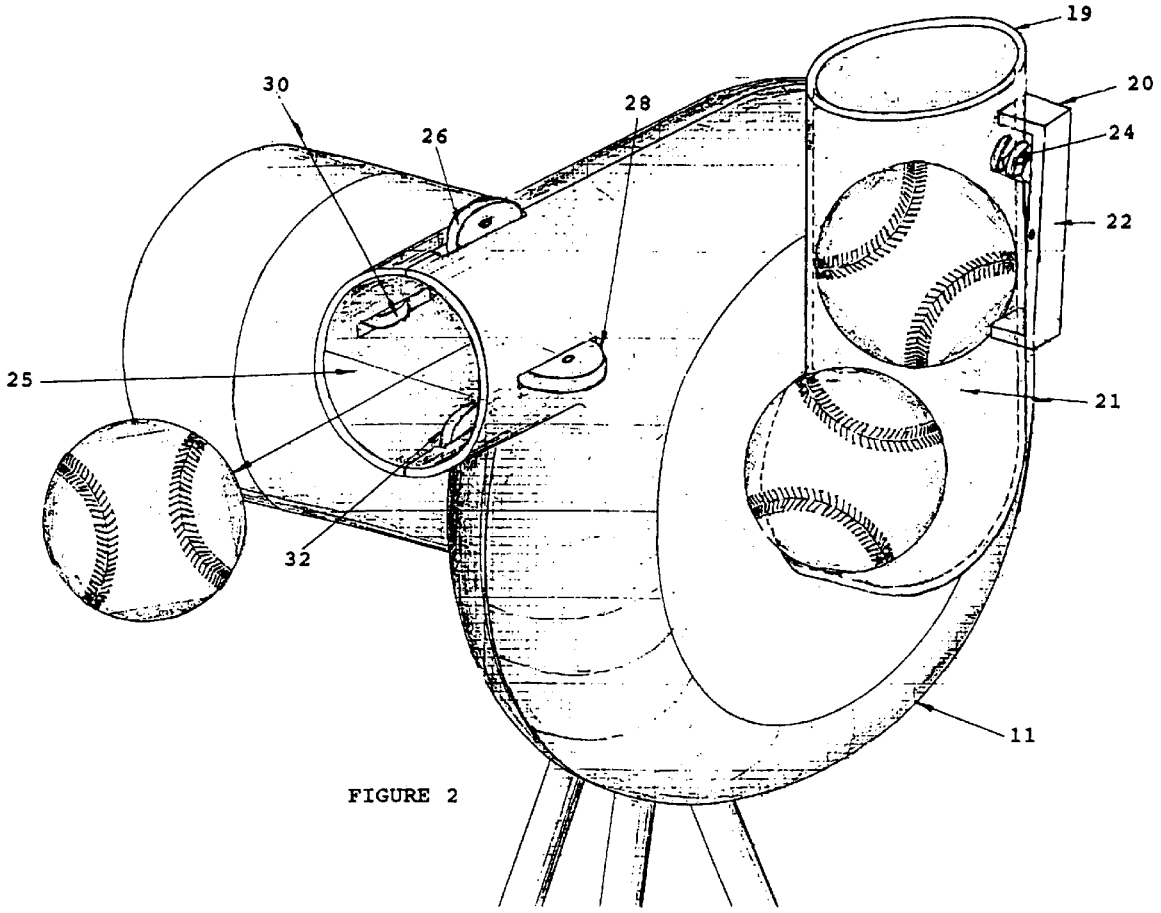
FIG. 2 is a more detailed view of the throwing apparatus of FIG. 1, with a ball feed mechanism shown in partial longitudinal section view.

FIG. 2 is a view of throwing apparatus 11 of FIG. 1, with ball feed member 19 shown in longitudinal section view. As is shown in FIG. 2, ball feed member 19 may include a feed control 20 which includes an actuator arm 22 which is biased by spring 24 to engage balls 21 as they pass through ball feed member 19. An electrically-actuated solenoid may be included to allow for direct operator actuation of feed control mechanism 20. Feed control mechanism 20 operates to slow the passage of balls through ball feed member 19 to allow the batter to regain his or her batting stance after hitting (or attempting to hit) the last ball discharged from throwing apparatus 11.

Figure 10A:
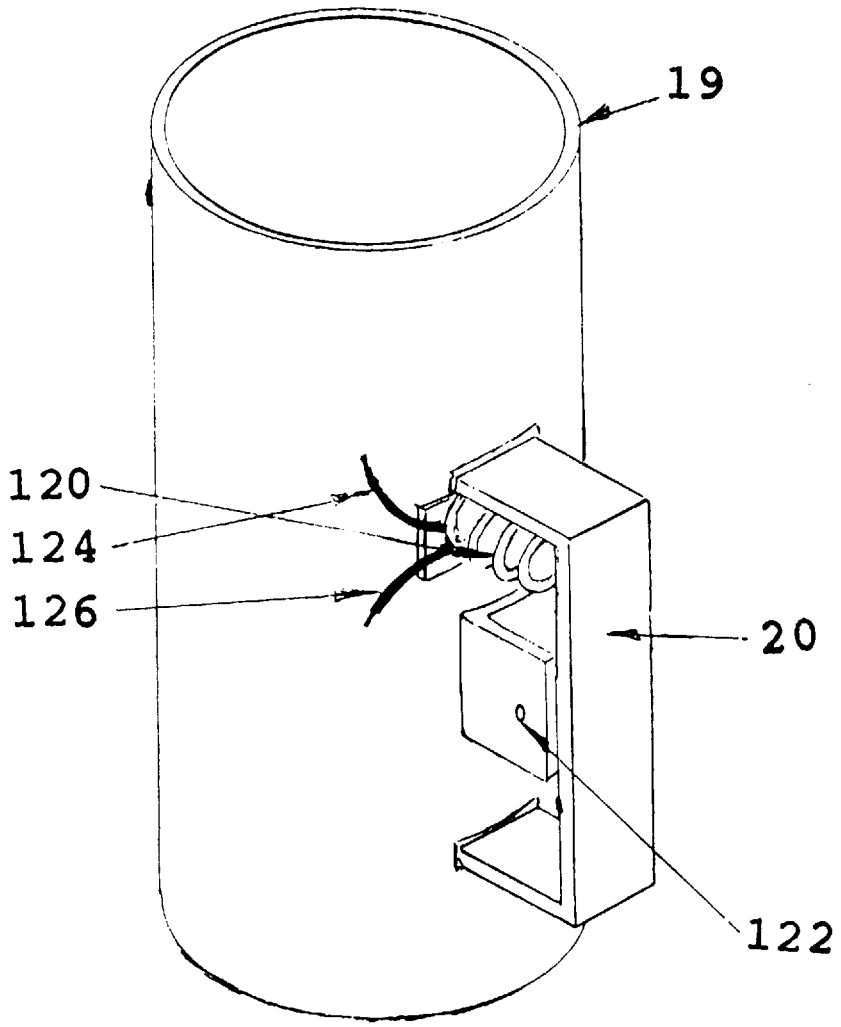
FIGS. 10A–10N depict details concerning the ball feed mechanism, the spin control mechanism, and remote control actuation of the throwing apparatus.
Figure 10D:
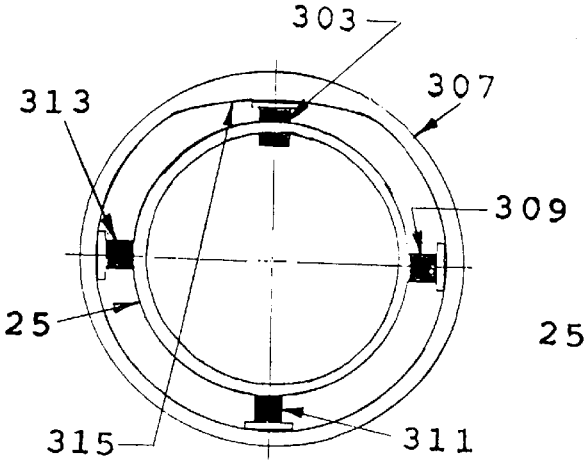
Figure 10E:
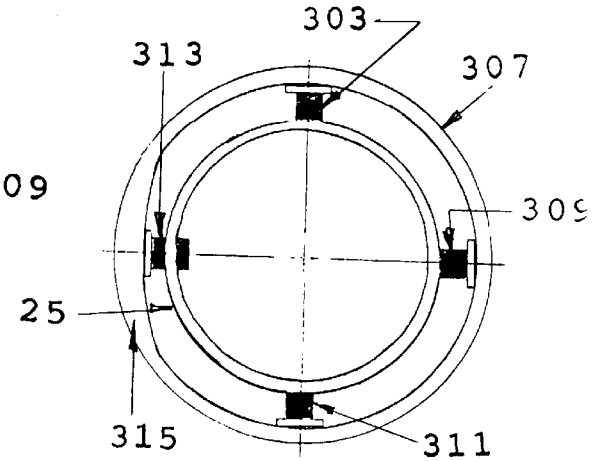
Figure 10F:
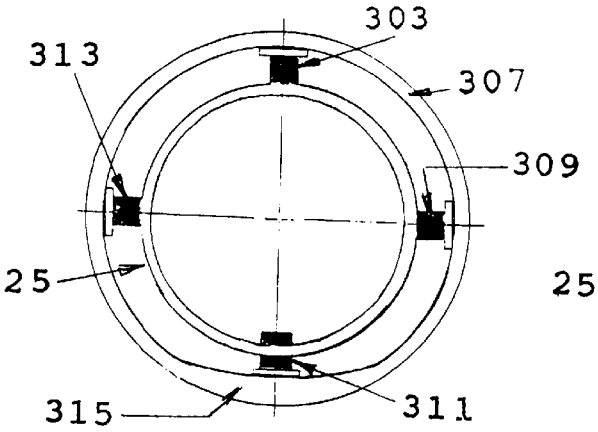
Figure 10G:
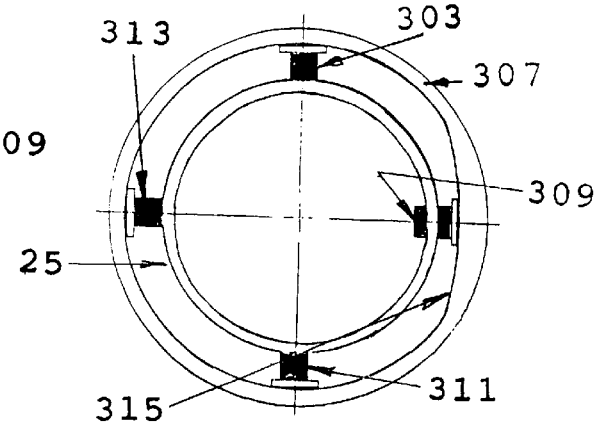

FIG. 10A depicts the utilization of an electrical solenoid to pivot actuator mechanism 20 relative to ball feed mechanism 19. As is shown, solenoid 120 is coupled between ball feed mechanism 19 and actuator mechanism 20 to one side of pivot 122. Electrical energy is selectively provided to solenoid via conductors 124, 126. Solenoid 120 includes a stationary portion which is fixed at position relative to ball feed mechanism 19, and a piston portion which is coupled to actuator mechanism 20. Electrically actuating the solenoid 120 will cause actuation mechanism 20 to pivot relative to ball feed mechanism 19, thus allowing balls to pass downward through ball feed mechanism 19 as actuation mechanism 20 is actuated.

Figure 10H:
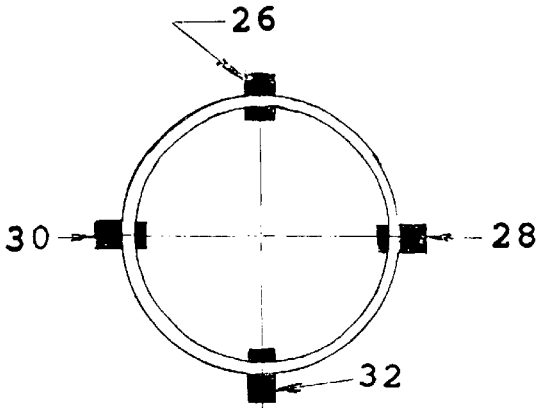
Figure 10I:
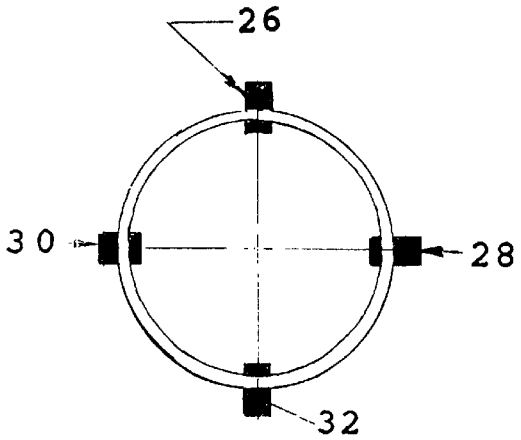
Figure 10J:
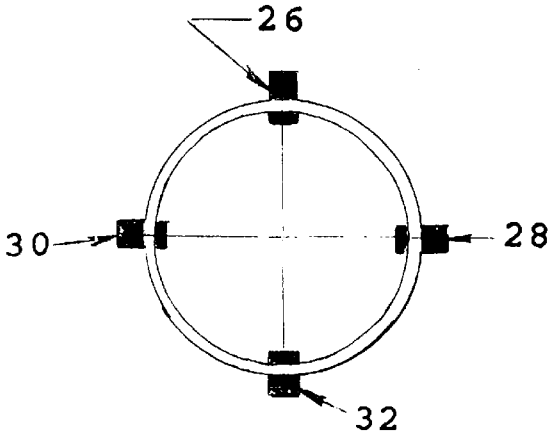
Figure 10K:
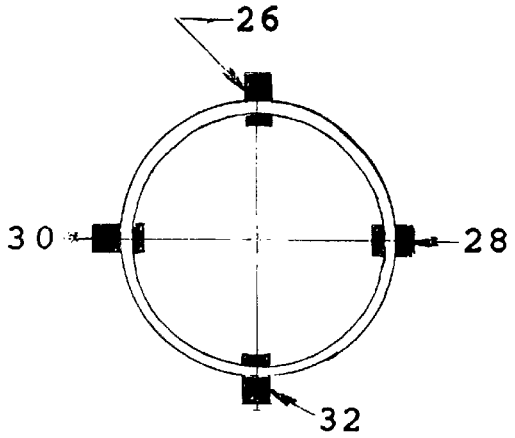
Figure 10L:
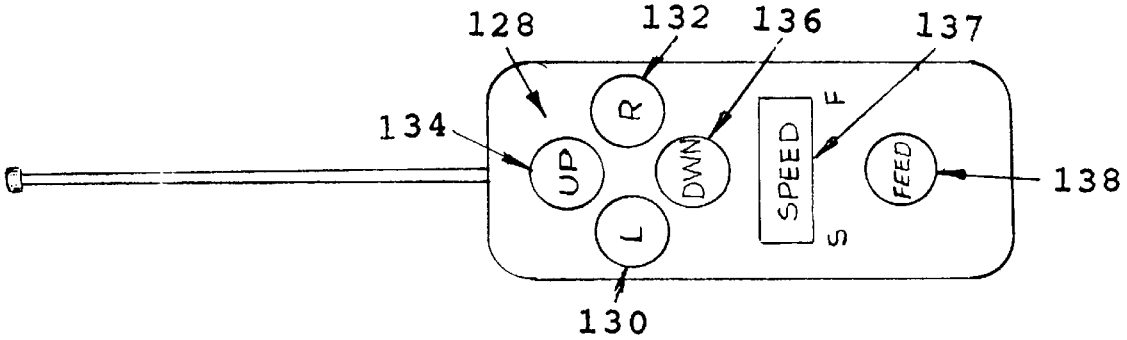
Figure 10M:
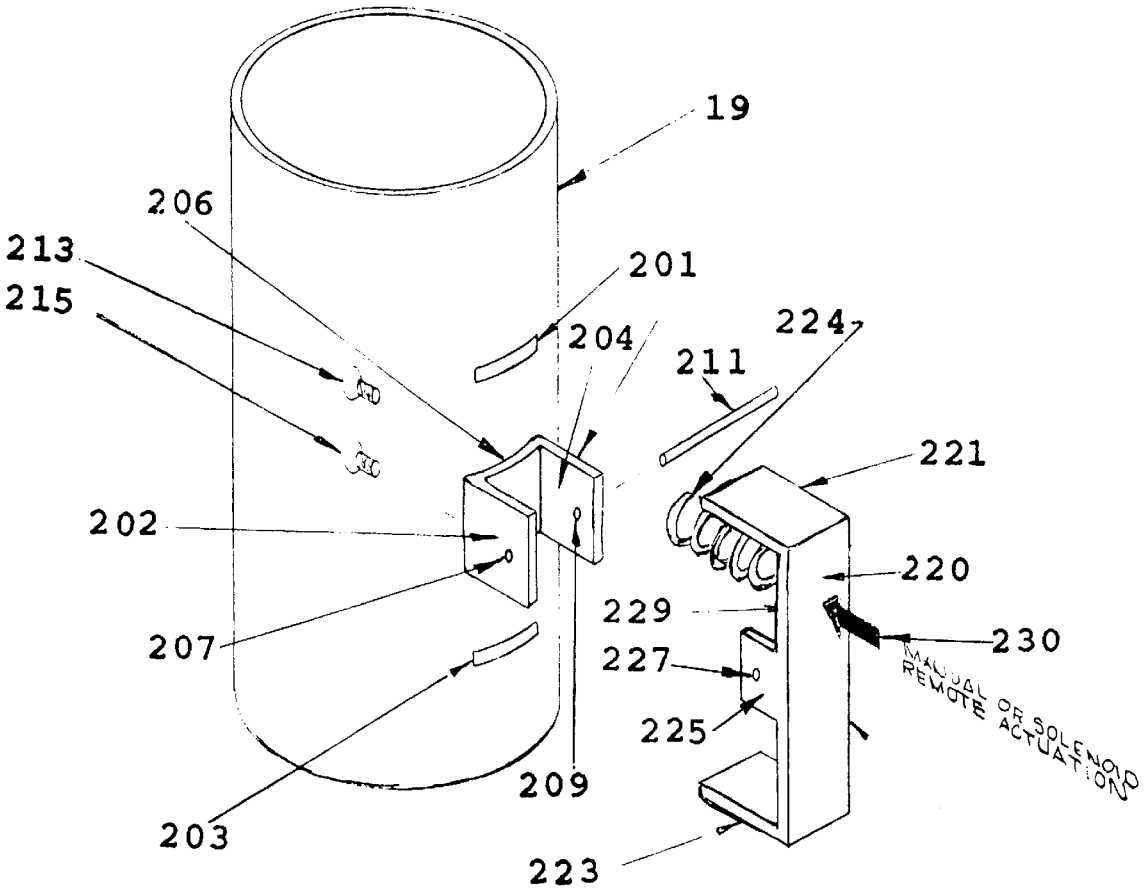

FIG. 10M depicts in greater detail the electrical solenoid and pivot actuator mechanism 20 of FIG. 10A. Ball feed mechanism 19 includes upper slot 201 and lower slot 203 which extend through the feed tube, and which are in parallel alignment and spaced apart a pre-selected distance. In an intermediate position between upper slot 201 and lower slot 203 is located a pivot bracket 205 which includes left flange 202, right flange 204, and intermediate curved piece 206. Aligned ports 207, 209 are disposed in left and right flanges 202, 204. Pivot bracket 205 is secured in position relative to upper and lower slots 201, 203 by screws 213, 215. A pivoting member 220 is also provided with an upper feed tab 221, and a lower feed tab 223. The tabs are sized to be accommodated in upper and lower slots 201, 203. A connector tab 225 is provided with ports 227, 229 disposed there through which are placed in alignment with ports 207, 209 of pivot bracket 205. Pin 221 extends through these ports to secure these components together. Preferably, a spring, such as spring 224, is utilized to bias pivot member 220, so that lower feed tab 223 is normally disposed within lower slot 203, while upper feed tab 221 in normally disposed outside of upper slot 201. Preferably, a solenoid, such as solenoid 120 is coupled between ball feed mechanism 19 and pivot actuator mechanism 20. The force of solenoid actuation is depicted in the view of FIG. 10M by force arrow 230. Basically, solenoid works against spring 224 to remove lower feed tab 223 from lower slot 203, and urge upper feed tab 221 into upper slot 201. This causes the release of a bottom ball when the lower feed tab 223 retracts. Simultaneously, upper feed tab 221 operates to hold the upper ball in position while the lower ball is dropping. When the force of the solenoid (as represented by force arrow 230) is released, spring 224 urges pivot member 220 back to a configuration wherein lower feed tab 223 is within lower slot 203, and upper feed tab 221 is removed upper slot 201.

The outlet 25 of throwing apparatus 11 may be equipped with spin control rollers 26, 28, 30, and 32. These rollers may be adjusted in position relative to ball outlet 25 in order to impart to an exiting ball a spin of a particular orientation. The preferred spin control mechanism includes four rotation dampers, which are either rollers or fingers, which can be controlled either mechanically or through the utilization of electrical solenoids, to allow remote operation. The embodiment which uses four rollers is depicted in FIG. 2. The rollers are spaced 90 degrees apart at ball outlet 25. All four rollers "freewheel", but have individual brake devices. If the roller has its brake applied, it spins less easily than the other freewheeling rollers, thus cancelling a component of the spin from the exiting ball. All other rollers would allow whatever spin component is carried by the ball at ball outlet 25 of throwing apparatus 11. Experimentation has determined that an exiting ball tends to rotate off of the braked roller and spins in that direction.

FIG. 10B depicts the configuration of a solenoid-actuated braking device which may be used in the present invention. As is shown, roller 81 includes a narrow exterior portion 83, and a relatively thicker interior portion 85. The periphery of interior portion 85 serves as a brake pad. Solenoid 87 (preferably a dormeyer solenoid) is mounted proximate roller 81, and includes brake shoe 89 which is brought into and out of contact with inner portion 85 as the solenoid is electrically energized via electrical conductors 91, 93. In this manner, a batter located at a remote position from throwing apparatus 11 may actuate one or more of the solenoids in contact with one or more of the rollers in order to resist spin of the roller as the ball engages the roller at ball outlet 25.

FIG. 10H graphically depicts the application of a solenoid braking device to roller 26. This will produce a ball which rises. FIG. 101 graphically depicts the application of the solenoid brake to roller 28. This will produce a ball which travels to the left. FIG. 10J depicts the application of the solenoid brake to roller 30. This will produce a ball which travels to the right. FIG. 10K graphically depicts the application of a solenoid brake to roller 32. This will produce a sinking ball.

A remote control apparatus 128 is depicted in FIG. 10L. It preferably includes a left button 130, a right button 132, a riser button 134, and sinker is button 136. Left button 130 is actuated when a ball with a leftward spin is desired. In contrast, the right button 132 is utilized when the ball with a rightward spin is desired. Riser button 134 is actuated when rising ball is desired, while sinker button 136 is actuated when a sinker ball is desired. The feed 138 is provided to allow either the batter or someone working with the batter to control the passage of balls through ball feed mechanism 19. The speed button 137 allows the batter to select the operating speed from a range of available speeds from fast (F) to slow (S).

The same result can be accomplished by utilizing four "fingers" which are spaced 90 degrees apart at ball outlet 25. All but one of the four fingers may be retracted. The remaining finger will engage the ball as it exits at ball outlet 25 and imparts spin to that side of the ball; this apparatus works, but is inferior to the use of rollers, since a substantial amount of exit velocity is dissipated with the fingers as opposed to the freewheeling rollers. This is believed to occur because the fingers force the ball to the side of the tube where friction losses occur.

Figure 10N:
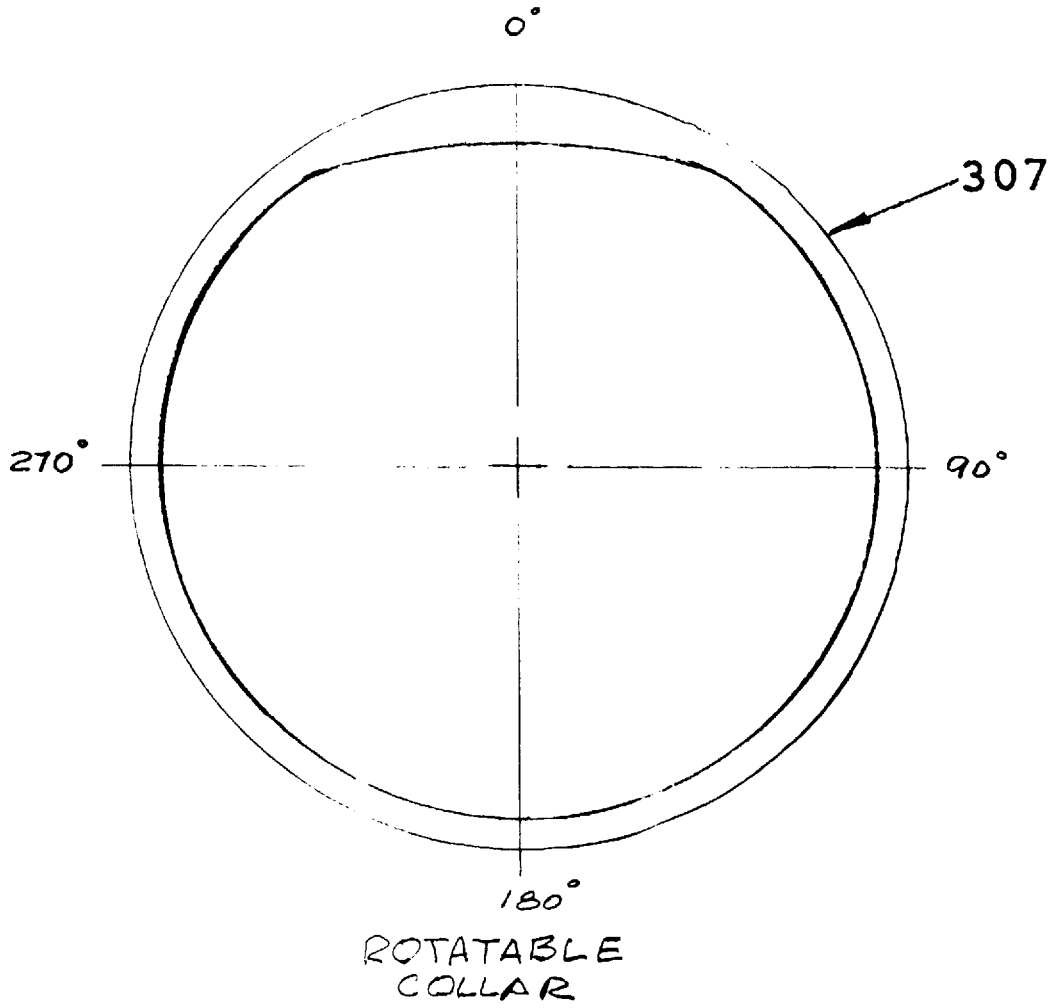

FIGS. 10C1 and 10C2 depict one type of finger assembly which can be utilized to impart a particular spin to a ball which is departing from the pitching apparatus of the present invention. FIG. 10C1 depicts finger 303 in a retracted position, while FIG. 10C2 depicts finger 303 in an engaged position. As is shown, a circular port 301 is provided in ball outlet 25, and is adapted in size and shape to accommodate the hemispheric finger 303 which is preferably formed from urethane. Finger 303 is secured to leaf spring 305, which serves to bias finger 303 outwardly, so that it is normally outside of port 301. A rotatable collar 307 is provided which may be utilized to urge finger 303 into port 301, where it is able to engage the baseball, softball, or tennis ball as it is exiting from exit port 25. In FIG. 10C1, a radially reduced portion of rotatable collar is disposed directly above finger 303, allowing leaf spring 305 to maintain finger 303 out of port 301. In contrast, in FIG. 10C2, a radially enlarged portion of rotatable collar 307 is disposed directly above finger 303, working against leaf spring 305, and urging finger 303 to extend into port 301, where it can engage the balls exiting from exit port 25. FIG. 10N depicts a rotatable collar 301. As is shown, rotatable collar 307 is circular along its outer portion, but includes an eccentric bore. The view of FIG. 10N is cross section view with a radial coordinate system superimposed thereon. Note that, in the region of the coordinate system from about 330° through about 30°, the rotatable collar is eccentric and enlarged as compared to other portions of the rotatable collar. Also note the central bore in the regions 90°, 180° and 270° is regular and symmetrical. In the preferred embodiment of the present invention, four fingers are located at 0°, 90°, 180°, and 270° about exit port 25, with rotatable collar 307 disposed about the fingers. This is depicted in FIGS. 10D–10G. The retractable collar 301 is adapted to be manually adjustable relative to ball outlet 25 of throwing apparatus 11. As is shown, fingers 303, 309, 311 and 313 are positioned 90 degrees apart at outlet 25. Collar 307 includes radially enlarged portion 315. The operator merely rotates collar 307 to a particular position in order to urge a particular finger downward into engagement with exiting balls in order to obtain a particular spin over balls exiting from throwing apparatus 11. The orientation depicted in FIG. 10D will produce a ball which rises, while the orientation of FIG. 10F will produce a ball which sinks. The orientation of FIG. 10E will produce a ball which travels to the right, while the orientation of FIG. 10G produces a ball which travels to the left.

Figure 3:
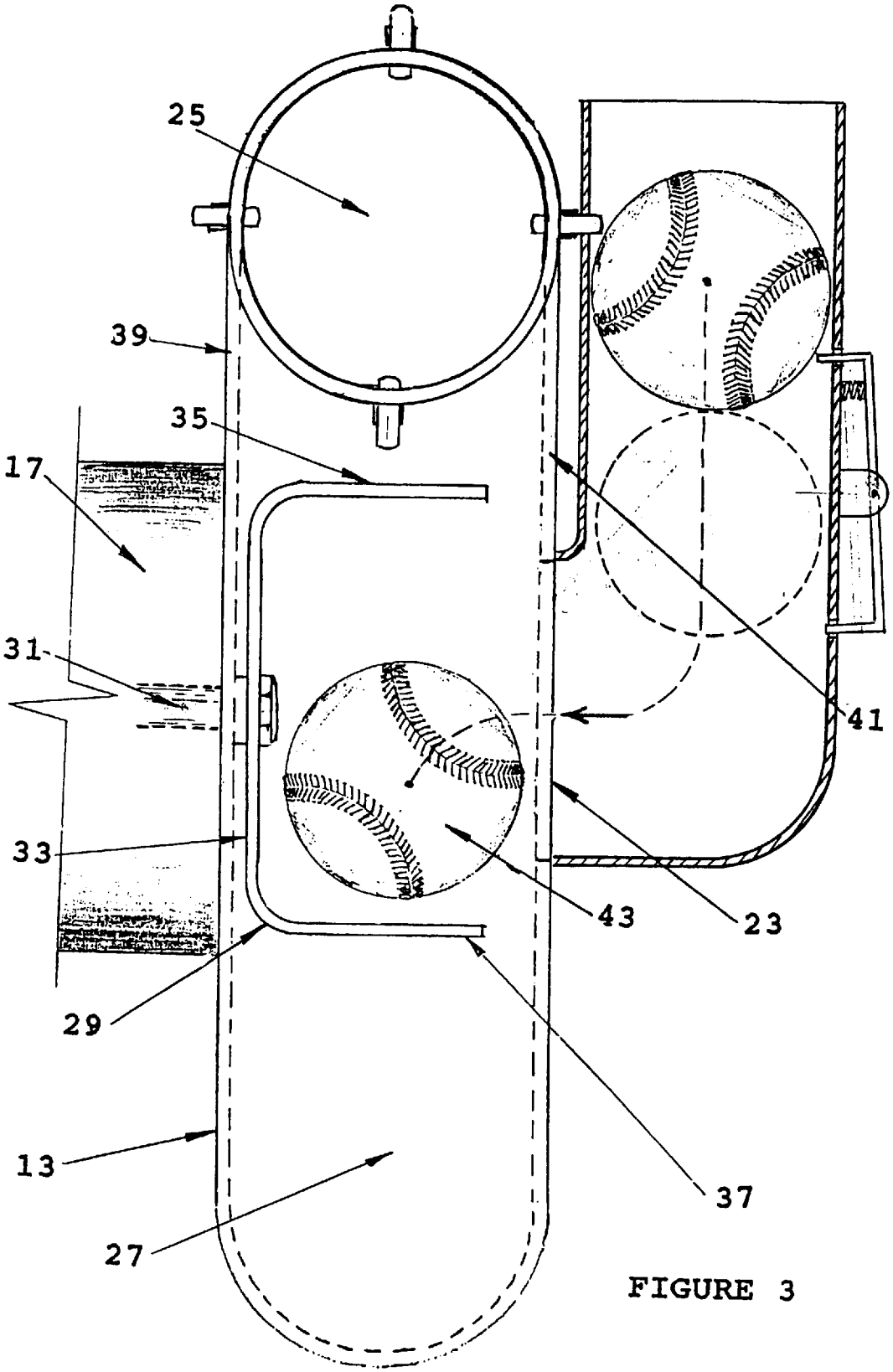
FIG. 3 is a cross-section view of the throwing apparatus of FIG. 2.

FIG. 3 is a longitudinal section view of stator member 13. As is shown, stator member 13 generally defines a disc-shaped cavity 27, which substantially encloses rotor member 29. Rotor member 29 is oriented directly below ball inlet 23. Ball outlet 25 is oriented substantially tangential to a circular path which is defined by the motion of rotor member 29, and which will be discussed in greater detail below. Rotor member 29 is preferably directly coupled to motor shaft 31 of motor 17. In this configuration, rotor member 29 is substantially orthogonal to motor shaft 31. In the present invention, energy losses are minimized by directly coupling rotor member 29 to motor shaft 31. No complicated pulley and belt assemblies are required. This greatly simplifies the manufacturing and assembly operations, while minimizing the probability of apparatus malfunction during ordinary use. As is shown in FIG. 3, rotor member 29 includes a mounting member 33 which is substantially parallel with inner surface 39 of stator member 13. Mounting member 33 is located proximate inner surface 39 to allow coupling with motor shaft 31 which extends through inner surface 39. Rotor member 29 further includes first and second rails 35, 37 which are spaced apart a selected distance which is sufficient to accommodate ball 43 as it is deposited into stator member 13 through ball inlet 23. As shown in FIG. 3, the ball drops through ball inlet 23 and is urged downward by gravity to engage (in this particular case) second rail 37. The trajectory of ball 43 is further depicted in detail in FIG. 8 which will be described below.

Figure 6:
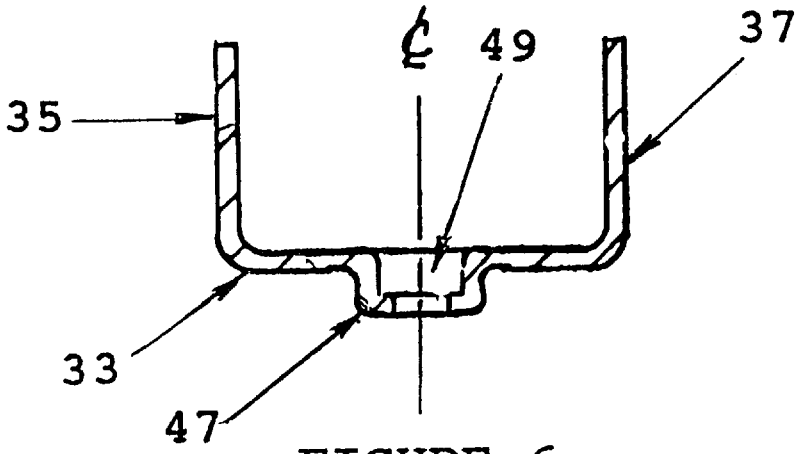
FIG. 6 is a section view of FIG. 4 as seen along section line B—B.
Figure 7:
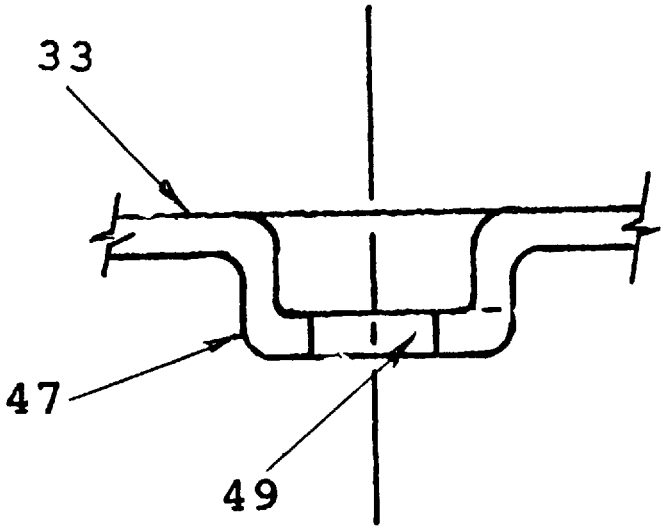
FIG. 7 is a detail view of a portion of FIG. 6.

The coupling between rotor member 29 and motor shaft 31 will be depicted and described in detail in connection with FIGS. 4, 5, 6, and 7. In FIG. 4, rotor member 29 is depicted in plan view. As is shown, rotor member 29 is 13.6 inches long with hexagonal nut 45 centrally disposed on mounting member 33. Hexagonal nut 45 includes internal threads which mate with external threads of motor shaft 31. FIG. 5 is a detail view of hexagonal nut 45 which is shown to have a diameter of 0.69 inches. FIG. 6 is a section view of FIG. 4 as seen along section line B—B. As is shown, first and second rails 35, 37 are spaced apart four inches, and extend outward from mounting member 33 a distance of 2.5 inches. Mounting member 33 includes seat 47 which is. adapted to accept hex nut 45. A shaft port 49 is provided in mounting member 33 to accommodate motor shaft 31 (which is not depicted in FIG. 6). Shaft port 49 is 0.440 inches in diameter. FIG. 7 provides a detail view of seat 47. As is shown, it extends downward from mounting member 33 by a distance of 0.25 inches.

Figure 8:
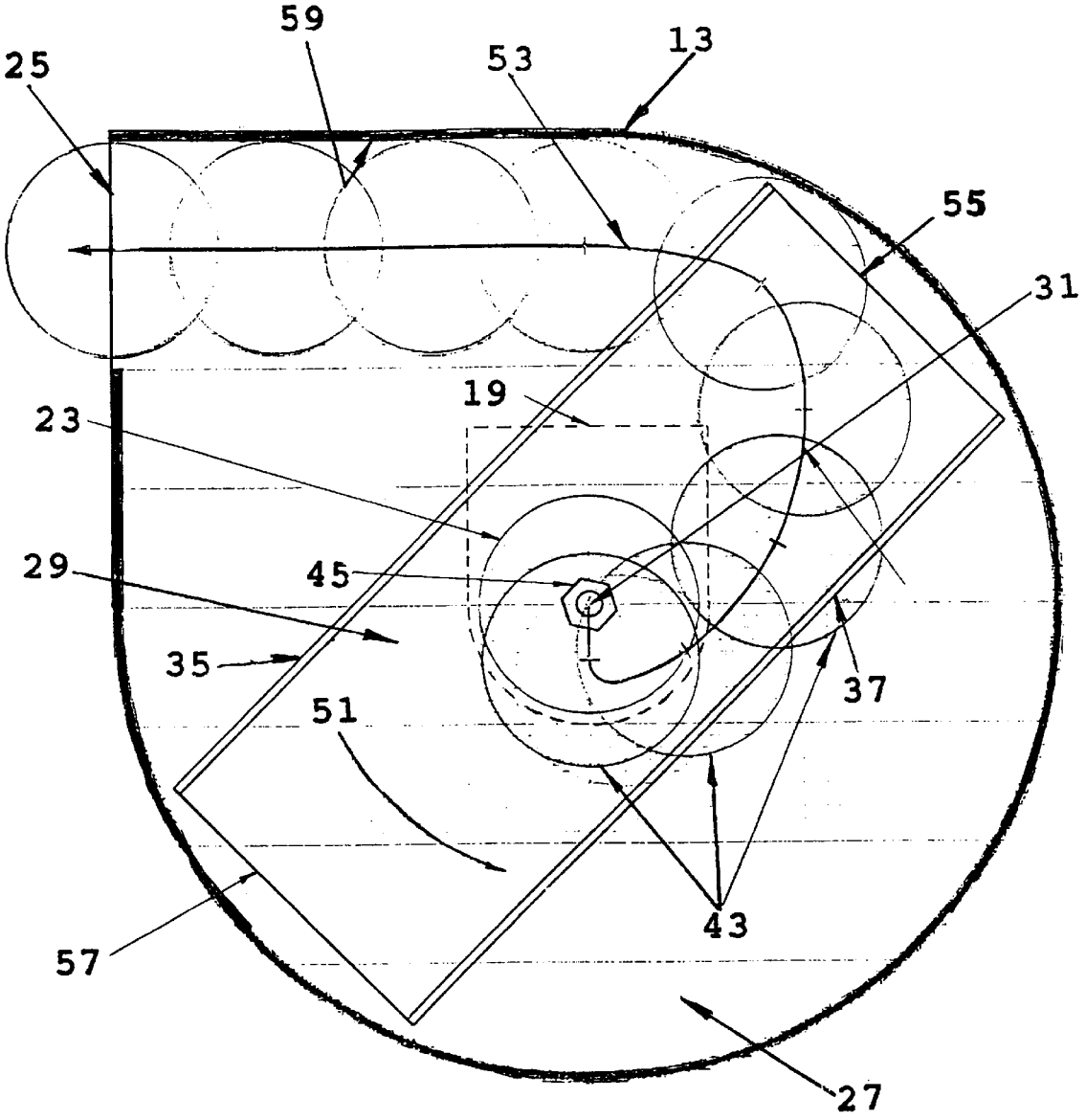
FIG. 8 is a section view of the stator member of the throwing apparatus of the present invention, which depicts the ball trajectory within the throwing apparatus.

FIG. 8 is a partial longitudinal section view of stator member 13. Discshaped cavity 27 which is defined by stator member 13 is adapted in circumference to accommodate rotor member 29 as it rotates in response to rotation of the motor shaft 31. A circular path is defined by the motion of motor member 29. Ball outlet 25 is disposed substantially tangentially to the circular path to allow the ball to exit from stator member 13 at a high velocity. Ball inlet 23 is disposed across disc-shaped cavity 27 from hex nut 45. In FIG. 7, the direction of rotation is marked by arrow 51, the path of ball 43 is depicted in phantom, and arrow 53 defines the trajectory of ball 43. As is shown, ball 43 is deposited into disc-shaped cavity 27 between first and second parallel rails 35, 37. It is urged downward by gravity during an initial ball reception mode of operation, and moves slightly away from the mid-section of rotor member 29 which is directly below ball inlet 23. Next, during a ball acceleration mode of operation, the ball is accelerated by centrifugal force as rotor member 29 is rotated. The ball gains velocity as it travels through the path of trajectory 53. In the view of FIG. 8, the ball exits from open end 55 of rotor member 29, and then is directed along inner surface 59 of stator member 13 on a path which is generally tangential to a circle defined by rotor member 29, until ball 43 exits from ball outlet 25 at a high velocity. As can be seen from FIG. 8, rotor member 27 need not be in any particular orientation in order to receive ball 43. Either open end 55 or open end 57 can serve as an outlet for ball 43 from rotor member 29. The ball path within stator member 13 is defined in part by first and second parallel rails 35, 37, but also is defined by mounting member 33 and by stator member 13 itself. Stator member 13 cooperates to contain ball 43 within rotor member 29 until it exists from either open end 55 or open end 57. Once it exists from open end 55, or open end 57, stator member 13 routes the ball along surface 59 until it reaches ball outlet 25.

"High throwing velocities can be obtained by". Utilization of an electrical motor which is capable of obtaining 3450 revolutions per minute and delivering on-third of a horsepower. In the preferred embodiment of the present invention, the electrical motor comprises a Model No. 3K802A, manufactured by Dayton Electric. Preferably, a variable speed control will be provided which allows for adjustment of the rate of rotation of the electrical motor in the range of 1075 rpm to 3450 rpm to allow all speeds in the range of 30+ miles per hour to 100+ miles per hour for baseballs, and roughly comparable speeds for softballs, and 30+ miles per hour to 120+ miles per hour for tennis balls. For softball usage, and especially for "slow pitch" softball, the stator may be inverted to place the ball exit at the lower position to simulate an underhand lob from 20 miles per hour, and up.

Figure 9:
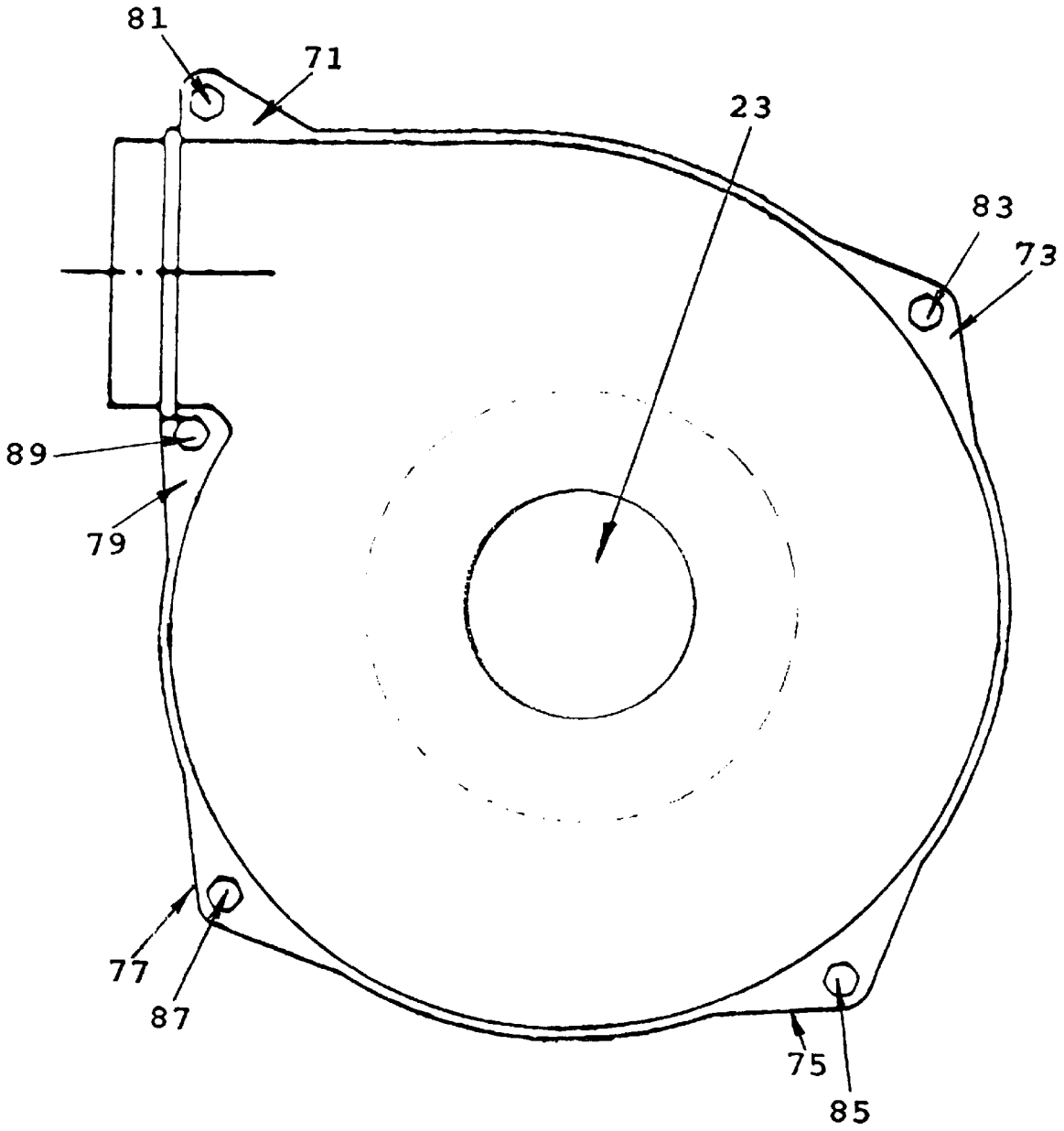
FIG. 9 is a top plan view of the stator member of the throwing apparatus of the present invention.

FIG. 9 provides a view of one preferred embodiment for stator member 13. In this particular embodiment, stator member 13 is composed of two halves which each include mounting pieces, such as mounting pieces 71, 83, 75, 77, and 79 which include bolt ports 81, 83, 85, 87, 89 which are adapted to receive bolts which are utilized to fasten together the two halves of stator member 13. One side includes ball inlet 23, while the other side includes a port which is adapted to allow the passage of motor shaft 31.

The present invention may also be characterized as a method of throwing a ball. First, an elongated rotor member is provided with a central inlet and first and second outlets at each end. Then, a housing is provided which at least partially encloses the elongated rotor. The elongated rotor is rotated at a high rate of rotation. A ball is introduced at the elongated rotor at the central inlet. Gravity is allowed to move the ball to a particular one of the first and second outlets of the elongated rotor. Centrifugal force from rotation of the elongated rotor is then utilized to accelerate the ball. The ball is then discharged from the elongated rotor at a high velocity.

While a particular basic construction is depicted and described herein, other more-expensive constructions are possible with the throwing apparatus 11 of the present invention. For example, the housing may be formed of thermo welded plastic with no bolts. Additionally, the rotor member may be formed of high impact injection molded plastic, with molded threaded inserts.

The present invention includes many advantages over the prior art devices.

First, all moving parts are enclosed within stator member 13, unlike the prior art devices which have many moving parts which are exposed and which may injure the operator if the product is misused. Thus, safety is maximized with the throwing apparatus 11 of the present invention.

Second, a small number of moving parts are utilized in the present invention. A motor turns a motor shaft which is directly coupled to a rotor. No other moving parts are required.

Third, the ease of manufacturing is increased with the present invention. One-half of stator member 13 is mounted on motor shaft 31. Then, rotor member 29 is placed over motor shaft 31, and a hex nut is placed over motor shaft 31 and tightened. Then, the second half of stator member 13 is coupled to the first half of stator member 13. Finally, the base 15 and ball feed member are coupled to stator member 13. Preferably, base 15 and ball feed 19 are releasably coupled to stator member 13 to facilitate transport of throwing apparatus 11.

Fourth, the throwing apparatus 11 of the present invention can be manufactured at a much lower cost than the prior art devices. It can also be serviced easily by relatively low skilled technicians.

Fifth, the throwing apparatus of the present invention can be utilized to throw balls at a range of speeds from 30 miles per hour to 100 miles per hour. Such high speeds are difficult to obtain with prior art devices, probably due to the fact that a great deal of energy was lost in the drive system. Additionally, in prior art devices, the forces dissipated through the drive system also adversely affect the baseballs or softballs. Conventional pitching devices utilized in batting cages typically expel molded urethane balls, and not baseballs, due to the fact that baseballs could not withstand numerous expulsions from the throwing device, since the rollers or gripping mechanisms tend to wear and tear upon the ball. The present invention is greatly advantageous over the prior art devices insofar as real baseballs/softballs can be utilized without significant adverse impact to the balls.

While the invention has been particularly shown and described with reference to a preferred embodiment, it will be understood by those skilled in the art that various changes in form and detail may be made therein without departing from the spirit and scope of the invention.

I claim:

1. An apparatus for throwing balls, comprising:

a rotor member including:

a mounting member for coupling with a shaft of a motor and which is positioned substantially orthogonal to said shaft of said motor; first and second parallel rails coupled to said mounting member and spaced apart a preselected distance which is sufficient to accommodate said balls for defining a ball path by restricting movement of said balls;

said motor having a motor shaft coupled to said rotor member for turning said rotor member;

a stator member having an inlet for receiving said balls and allowing passage to a region between said first and second parallel rails, and an outlet for discharging said balls from said region between said first and second parallel rails;

wherein said stator member completely encloses said rotor member and motor shaft thus enclosing all moving parts.

2. An apparatus according to claim 1:

wherein said stator member defines a generally disc-shaped cavity having a predefined circumference and a predefined width; and wherein said first and second parallel rails are sufficiently long to extend across said predefined circumference of said disc-shaped cavity and sufficiently wide to extend across said predefined width of said disc-shaped cavity.

3. An apparatus according to claim 1:

wherein said inlet of said stator member is located at an axis of rotation of said rotor member.

4. An apparatus according to claim 1:

wherein said inlet of said stator member is located opposite from said mounting member, at an axis of rotation of said rotor member, for depositing said balls intermediate said first and second parallel rails.

5. An apparatus according to claim 1:

wherein said motor shaft couples to said rotor at a midpoint on said rotor.

6. An apparatus according to claim 1;

wherein said stator member has a centrally located inlet for receiving said balls and a tangentially located outlet for discharging said balls.

7. An apparatus according to claim 1:

wherein movement of said rotor defines a circular path; and wherein said outlet is located on said stator member at a position tangential to said circular path.

8. An apparatus according to claim 1, further comprising:

an adjustable deflector member located at said outlet for modifying a trajectory for said balls.

9. An apparatus according to claim 8:

wherein said adjustable deflector member includes a roller member which engages said balls and spins said balls in a particular one of plurality of available directions.

10. An apparatus according to claim 1:

wherein said motor shaft is directly coupled to said rotor member.

11. An apparatus according to claim 1:

wherein said rotor member is an elongated member which defines a ball path and which is open at both of first and second ends.

12. An apparatus for throwing a ball, comprising:

an elongated rotor member which defines a ball path and which includes first and second ends and a midsection;

a motor having a motor shaft which engages said elongated rotor at said midsection; and a stator member completely enclosing said rotor member and motor shaft thus enclosing all moving parts, and having an inlet located proximate said midsection of said elongated rotor and an outlet which is substantially tangential to a rotation path defined by said first and second ends of said elongated rotor member;

which is operable in a plurality of modes of operation including:

a ball reception mode of operation wherein a ball is received at said inlet of said stator member, and urged by gravity away from said midsection;

a ball acceleration mode of operation wherein said ball is accelerated by centrifugal force as said rotor member is rotated; and a ball discharge mode of operation wherein said ball exits from said rotor from a particular one of said first and second ends and is routed by said stator member to exit from said outlet at a high velocity.

13. An apparatus according to claim 12:

wherein said elongated rotor member includes first and second spaced-apart rails which at least partially define said ball path.

14. An apparatus according to claim 13:

wherein said stator member cooperates with said first and second spaced-apart rails to define said ball path.

15. An apparatus according to claim 12:

wherein gravity and centrifugal force cooperate to direct said ball to a particular one of said first and second ends of said elongated rotor member dependent upon the position of said elongated rotor member relative to said stator member at the initiation of said ball reception mode of operation.

16. An apparatus according to claim 12 wherein said elongated rotor member comprises:

a mounting member for coupling with said shaft of said motor and which is positioned substantially orthogonal to said shaft of said motor; and first and second parallel rails coupled to said mounting member and spaced apart a preselected distance which is sufficient to accommodate said ball.

17. An apparatus according to claim 12 wherein said stator member defines a generally disc-shaped cavity having a predefined circumference and a predefined width; and wherein said elongated rotor member is sufficiently long to extend across said predefined circumference of said disc-shaped cavity and sufficiently wide to extend across said predefined width of said disc-shaped cavity.

18. An apparatus according to claim 12:

an adjustable deflector member located at said outlet for modifying a trajectory for said ball.

19. A method of throwing a ball, comprising:

providing an elongated rotor member with a central inlet and first and second outlets at each end, and engaged by a motor shaft;

providing a housing which encloses said elongated rotor and said motor shaft;

rotating said elongated rotor at a high rate of rotation; introducing a ball into said elongated rotor at said central inlet;

allowing gravity to move said ball to a particular one of said first and second outlets of said elongated rotor;

utilizing centrifugal force from rotation of said elongated rotor to accelerate said ball; and discharging said ball from said elongated rotor at a high velocity.

20. A method according to claim 19, further comprising:

providing a tangential outlet from said housing which communicates with said first and second outlets of said elongated rotor;

utilizing said tangential outlet for discharging and directing said ball.

21. A method according to claim 19:

wherein a motor is utilized for rotating said elongated rotor; and wherein a shaft of said motor is directly coupled to said elongated rotor.

22. An apparatus for throwing a ball comprising:

a motor having a motor shaft;

a rotor member, including:

(a) a mounting member for coupling with said shaft of said motor;

(b) first and second parallel rails coupled to said mounting member and spaced apart a preselected distance;

(c) a midsection; and (d) open first and second ends;

a stator member including:

(a) a housing portion for substantially enclosing said rotor member;

(b) said housing generally defining a disc-shaped cavity being sufficiently wide to cooperate with said first and second parallel rails to define a ball path between said first and second ends;

(c) an inlet member located proximate said mid section of said rotor member opposite from said mounting member;

(d) an outlet member located tangential to a circular path defined by said first and second ends of said rotor member;

which is operable in a plurality of modes of operation, including:

(a) a ball reception mode of operation wherein a ball is received at said inlet of said stator member, and urged by gravity away from said midsection;

(b) a ball acceleration mode of operation wherein said ball is accelerated by centrifugal force as said rotor member is rotated; and (c) a ball discharge mode of operation wherein said ball exits from said rotor from a particular one of said first and second ends and is routed by said stator member to exit from said outlet at a high velocity.

23. An apparatus according to claim 22:

wherein said inlet of said stator member is located opposite from said mounting member, at an axis of rotation of said rotor member, for depositing said balls intermediate said first and second parallel rails.

24. An apparatus according to claim 22:

an adjustable deflector member located at said outlet for modifying a trajectory for said balls.

25. An apparatus according to claim 24:

wherein said adjustable deflector member includes a roller member which engages said balls and spins said balls in a particular one of plurality of available directions.

26. An apparatus according to claim 22:

wherein gravity and centrifugal force cooperate to direct said ball to a particular one of said first and second ends of said rotor member dependent upon the position of said rotor member relative to said stator member at the initiation of said ball reception mode of operation.

* * * * *